United States Patent [19]

Kucza

[11] Patent Number: 4,715,195

[45] Date of Patent: Dec. 29, 1987

[54] APPARATUS FOR RAPID COOLING OF CONTAINERS

[76] Inventor: Iosif Kucza, 160 Chalkfarm Drive, Apt. 818, Downsview, Ontario, M3L 2J1, Canada

[21] Appl. No.: 56,638

[22] Filed: Jun. 2, 1987

[51] Int. Cl.[4] ..... F25D 17/02

[52] U.S. Cl. ..... 62/376; 62/378; 62/438; 62/458; 62/465

[58] Field of Search ..... 62/62, 63, 378, 458, 62/465, 466, 59, 376, 381, 438

[56] References Cited

U.S. PATENT DOCUMENTS

| | | | |
|---|---|---|---|
| 1,092,330 | 4/1914 | Blake | 62/378 X |
| 1,869,119 | 9/1927 | Replogle . | |
| 2,061,427 | 8/1935 | King | 62/438 |
| 2,203,439 | 7/1938 | Oliver . | |
| 2,226,271 | 12/1940 | Vose | 62/59 X |
| 2,303,000 | 11/1942 | Ribble | 62/378 X |
| 2,314,317 | 3/1943 | Walter | 62/62 |
| 2,555,425 | 5/1949 | Stern . | |
| 2,618,134 | 12/1949 | Kaufman . | |
| 2,736,174 | 1/1954 | Tice . | |
| 2,993,346 | 3/1960 | Mills | 62/64 |
| 3,440,831 | 4/1969 | Thompson | 62/63 |
| 3,595,030 | 7/1971 | Roslonski | 62/441 |
| 3,738,121 | 6/1973 | Swindell | 62/378 |
| 3,888,092 | 6/1975 | Fisher | 62/376 |
| 4,164,851 | 8/1979 | Bryant | 62/381 |
| 4,541,251 | 9/1985 | Louradour et al. | 62/64 |
| 4,568,369 | 2/1986 | Destruhaut | 62/64 |

*Primary Examiner*—Lloyd L. King
*Attorney, Agent, or Firm*—R. Craig Armstrong

[57] ABSTRACT

An apparatus for rapid cooling of bottles, cans or other containers of liquid or of solid materials is disclosed. The apparatus is comprised of a top-opening cabinet which has a tub for holding liquid and a refrigeration unit for cooling the liquid in the tub. A plate having an opening is placed across the tube and a bag is positioned in the opening so that it extends into the liquid. The bag is made of a thin, flexible, water impervious material and it is sealed across the opening in the plate so that direct access to the liquid is prevented. The container is placed in the bag which then substantially conforms to the shape of that part of the container lying below the surface of the liquid. The container's contents are cooled without the container ever coming into direct contact with the liquid.

10 Claims, 3 Drawing Figures

APPARATUS FOR RAPID COOLING OF CONTAINERS

BACKGROUND OF THE INVENTION

1. Field of the Invention

This invention relates generally to refrigeration devices and more specifically to an apparatus for rapidly cooling bottles, cans, or other containers of liquid.

2. Description of the Prior Art

There are many types of refrigeration devices taught by the prior art. The devices range from those for refrigerating large quantities of articles to those which are used to cool one bottle of liquid at a time. The apparatus of the present invention is of the type that is used to cool a few articles at a time and which is suitable for use in restaurants and hotels where it is difficult or undesirable to refrigerate large quantities of bottles or cans for long periods of time. Several patents have previously been granted for refrigeration devices for similar use, including U.S. Pat. No. 4,164,851 granted on Aug. 21, 1979 to Bryant; U.S. Pat. No. 2,736,174 granted on Jan. 11, 1954 to Tice; and U.S. Pat. No. 2,061,427 granted on Aug. 16, 1935 to King. The structure of the devices as disclosed in these patents is fairly complex.

SUMMARY OF THE INVENTION

It is an object of the present invention to provide a simpler and improved apparatus for rapid cooling of bottles, cans or other containers of liquids or for cooling solid materials.

The apparatus of the present invention comprises a top-opening cabinet which has a tub for holding a liquid such as alcohol, and a refrigeration unit connected to the tub for cooling the liquid. An insulated plate which has an opening is positioned across the tube. A thin, flexible, liquid impervious bag is inserted into the tube through the opening so that a substantial part of the bag is in contact with the liquid. The bag is sealed across the opening in the plate thereby preventing direct access to the liquid from outside the cabinet. The bottle or can to be cooled is placed in the bag which then substantially conforms to the shape of that part of the bottle or can which lies below the surface of the liquid. The temperature of the liquid inside the bottle or can be lowered while the can remains dry as it does not lie in direct contact with the fluid. The apparatus may be supplied with various other features such as a pump for circulating the liquid in the tub, a timer and a thermostat.

BRIEF DESCRIPTION OF THE DRAWINGS

The preferred embodiment of the invention will now be more fully described with the aid of the following drawings in which.

DETAILED DESCRIPTION OF THE PREFERRED EMBODIMENT

Figure 1:
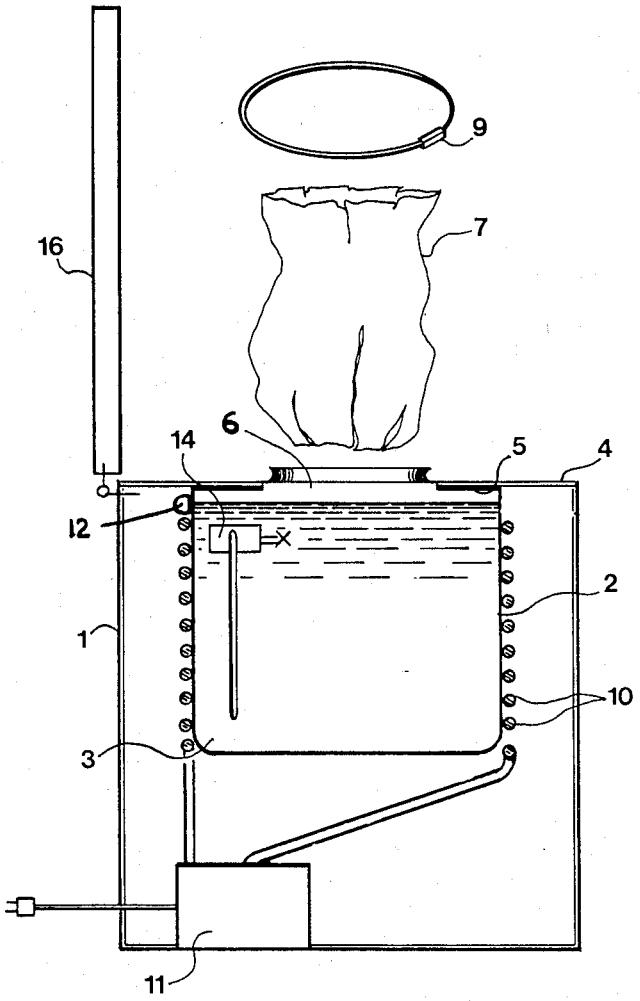
FIG. 1 is an exploded side view of the preferred embodiment of the invention without a bottle or can in the bag.
Figure 2:
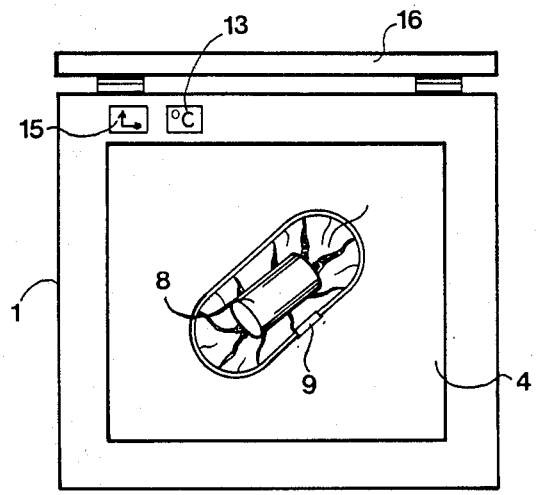
FIG. 2 is a top view of the preferred embodiment of the invention with a can positioned in the bag.
Figure 3:
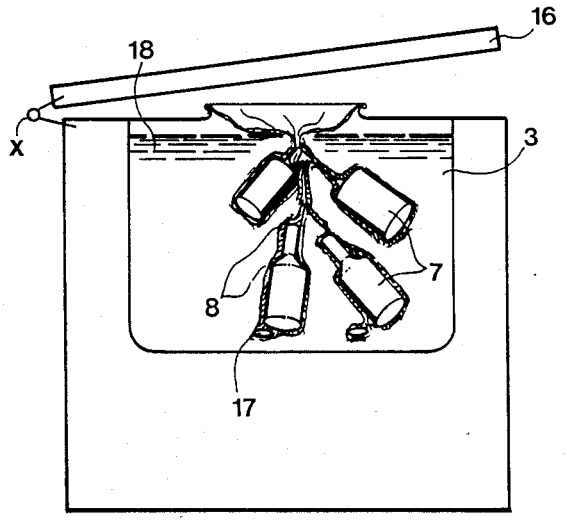
FIG. 3 is a side view showing the preferred embodiment of the invention in use.

The apparatus comprising a top opening cabinet 1 which has a tub 2 for holding a liquid 3 such as alcohol. A plate 4 is positioned across the tub 2 to prevent outside access to the liquid 3. The plate 4 has a layer of insulation 5 and an opening 6.

A bag 7 is inserted into the opening 6 in such a manner that it extends into the tub 2 and comes into contact with the liquid 3. The bag 7 is made of any suitable thin, flexible, liquid impervious material, such as nylon, silicon rubber or latex. The material is of such a type that when a container 8 is placed in the bag 7, the material substantially conforms to the shape of that part of the container 8 which lies below the surface of the liquid 3. This close contact with the cooling liquid allows for ready transfer of energy between the container 8 and the cold liquid 3.

The bag 7 is sealed across the opening 6 by means of a clamp 9. The bag 7 may be removably sealed across the opening 6 and may be detachable from the clamp 9, thereby allowing for the replacement of a bag which has become damaged during use.

The bag 7 is preferably larger in surface area than the tub 2, and may be held in the liquid 3 by lead weights 17 placed at spaced intervals in the bottom of the bag, or by some other suitable means. The large bag 7 allows for a number of containers 8 to be inserted into the bag, and for the material to substantially conform to the shape of the containers 8. If the bag 7 is fairly small, the material does not conform substantially to the entire shape of the containers 8, and the containers 8 may be cooled less quickly. The weights 17 act to keep the bag suspended in the liquid 3. If no weights 17 are used, the bag 7 may tend to float on the surface 18 of the liquid 3. At some point, the sides of the bag 7 are forced together thereby effectively sealing the bag 7.

The evaporator 10 of the refrigeration unit 11 is coiled around the tub 2. The thermostat sensor 12 is positioned against the tub 2. The refrigeration unit 11 and thermostat sensor 12 regulate the temperature of the liquid 3. The thermostat 13 is positioned on the cabinet 1 to allow the operator to set the temperature of the liquid 3 at a desired level.

A pump 14 is provided to circulate the liquid 3 to minimize the difference in temperature between the liquid near the bottom of the tub 2, and the liquid near the top of the tub 2. The circulation of the liquid 3 also tends to increase the rate of exchange of energy between the container 8 and the liquid 3 by ensuring that cold liquid stays in contact with the bag 7.

A timer 15 is positioned on the cabinet 1 to regulate the amount of time that a container 8 is left in the bag 7 and to ensure that the contents of the container 8 do not freeze. When the apparatus is not in use the top 16 of the cabinet 1 may be closed.

It is to be understood that more than one container can be placed in the bag at one time as the bag will substantially conform to the shape of all those parts of the containers that lie below the surface of the liquid. It is also to be understood that both solid materials, such as meat, and liquids can be rapidly cooled in a cooling apparatus made in accordance with the present invention.

What is claimed as the invention is:

1. Apparatus for cooling articles comprising:

a top-opening cabinet;

a tub in the cabinet for holding liquid;

a plate across the tub, said plate having an opening;

refrigeration means connected for cooling the liquid; and an open bag for holding the article, where the bag extends into the tub and the periphery of the bag is sealed across the opening in the plate thereby preventing direct access to the liquid from outside the cabinet, and where the bag is of a thin, flexible, liquid-impervious material;

whereby when sufficient liquid is placed in the hub so that a substantially part of the bag is in contact with the liquid and an article is placed in the bag, the bag will substantially conform to the shape of that part of the article lying below the surface of the liquid.

2. Apparatus as defined in claim 1 wherein said bag is made by nylon.

3. Apparatus as defined in claim 1 wherein said bag is made of latex.

4. Apparatus as defined in claim 1 wherein said bag is made of silicon rubber.

5. Apparatus as defined in claims 2, 3 or 4 further comprising a pump positioned in said tub for circulation of the liquid.

6. Apparatus as defined in claims 2, 3 or 4 further comprising a timer positioned on said cabinet.

7. Apparatus as defined in claims 2, 3 or 4 further comprising a thermostat positioned to monitor the temperature of the liquid.

8. Apparatus as defined in claim 1 wherein the bag is sealed across the opening in the plate by means of a clamp.

9. Apparatus as defined in claim 1 or 8 wherein the bag is removably sealed across the opening in the plate.

10. Apparatus as defined in claim 1 wherein the liquid is alcohol.

* * * * *

UNITED STATES PATENT AND TRADEMARK OFFICE

CERTIFICATE OF CORRECTION

PATENT NO. : 4,715,195

DATED : December 29, 1987

INVENTOR(S) : Iosif Kucza

It is certified that error appears in the above-identified patent and that said Letters Patent is hereby corrected as shown below:

Column 1, line 46, "be" should read -- is --.

Column 3, line 5, "hub" should read -- tub --,

Column 3, line 6, "substantially" should read -- substantial --.

Signed and Sealed this

Twenty-sixth Day of July, 1988

*Attest:*

DONALD J. QUIGG

*Attesting Officer*

*Commissioner of Patents and Trademarks*